United States Patent [19]

Bertolini

[11] Patent Number: 4,898,413

[45] Date of Patent: Feb. 6, 1990

[54] MANUAL CONTROL DEVICE FOR OPENING A VEHICLE DOOR

[75] Inventor: Carlo Bertolini, Les Bordes, France

[73] Assignee: Rockwell-CIM, France

[21] Appl. No.: 207,078

[22] Filed: Jun. 14, 1988

[30] Foreign Application Priority Data

Jun. 18, 1987 [FR] France ..... 87 08558

[51] Int. Cl.[4] ..... E05C 3/08

[52] U.S. Cl. ..... 292/336.3; 292/347; 292/DIG. 31; 292/196

[58] Field of Search ..... 292/97, 91, 93, 123, 292/139, 167, 196, 223, 336.3, 347, DIG. 31, DIG. 49

[56] References Cited

U.S. PATENT DOCUMENTS

| | | | |
|---|---|---|---|
| 926,545 | 6/1909 | Carpenter | 292/93 X |
| 3,877,262 | 4/1975 | Williams | 292/92 X |
| 4,580,821 | 4/1986 | Genord, Jr. et al. | 292/DIG. 31 X |

*Primary Examiner*—Richard E. Moore

[57] ABSTRACT

A knob (3) capable of pivoting an actuating lever (4) of a latch and articulated to a case (1) which is open toward the exterior and capable of receiving the knob (3). The latter is laterally articulated to pivot, on one hand, about two pins (16, 17) fixed to the case (1) and, on the other hand, about two movable pins (14, 15) integral with the knob. All of the pins are within the case (1). Each pin (16, 17) fixed to the case is connected by a link (9, 11; 12, 13) to a movable pin (14, 15) and all the pins (14 to 17) are so positioned that straight lines (D1, D2) each passing through a fixed pin (16, 17) and through a movable pin (14, 15) interconnected by the same link intersect outside the case. This articulated mechanism permits mounting on the door the unit comprising the case (1) and the knob (3) by a simple succession of horizontal movements of translation which may also be effected by a robot of very simple design.

3 Claims, 5 Drawing Sheets

MANUAL CONTROL DEVICE FOR OPENING A VEHICLE DOOR

The present invention relates to a manual control device for opening a vehicle door, of the type comprising a knob capable of pivoting an actuating lever of an associated latch and articulated to a case which is open toward the exterior and capable of receiving the knob, in such manner that when the knob is in the position of rest, its outer surface is substantially in the plane of the outer panel of the door.

The case also contains a key barrel and an element adapted to actuate the means for rendering the latch inoperative.

Owing to the position outside the case, to the rear and above the latter, of the axis of rotation of the knob, the placing of the assembly comprising the case and the knob in position in the door requires a sequence of relatively complex movements effected by hand on the vehicle assembly lines. Such a sequence cannot be subdivided into simple movements of vertical translation and/or horizontal translation capable of being very easily effected by robots.

An object of the invention is therefore to provide an articulation mechanism for the knob which is such that the effective articulation axis of this knob is brought back into the interior of the case. This permits simplifying the sequence of movements for placing the preassembled case-knob unit in position, only the horizontal movements of translation capable of being effected by a robot remaining necessary.

According to the invention, the knob is laterally articulated to pivot, on one hand, about two pins fixed to the case and, on the other hand, about two movable pins mounted on the knob, all these pins being within the case, each pin fixed to the case being connected by a link to a movable pin and said pins being so positioned that straight lines each passing through a fixed pin and a movable pin interconnected by the same link intersect outside the case.

Consequently, the knob is articulated by a system of deformable quadrilaterals the sides of which are defined by the two fixed pins and the two movable pins.

According to one embodiment of the invention, the knob comprises a plate provided with two lateral side walls extending inside the case and respectively articulated to two links of which the articulations to the side walls constitute the movable pins and the articulations to the case form the fixed pins, and two links each cooperative with a respective side wall are integral with a connecting member so adapted that its pivoting about the two associated fixed pins drives the actuating lever of the latch.

Further features and advantages of the invention will be apparent from the following description with reference to the accompanying drawings which illustrate by way of example a non-limitative embodiment.

Figure 1:
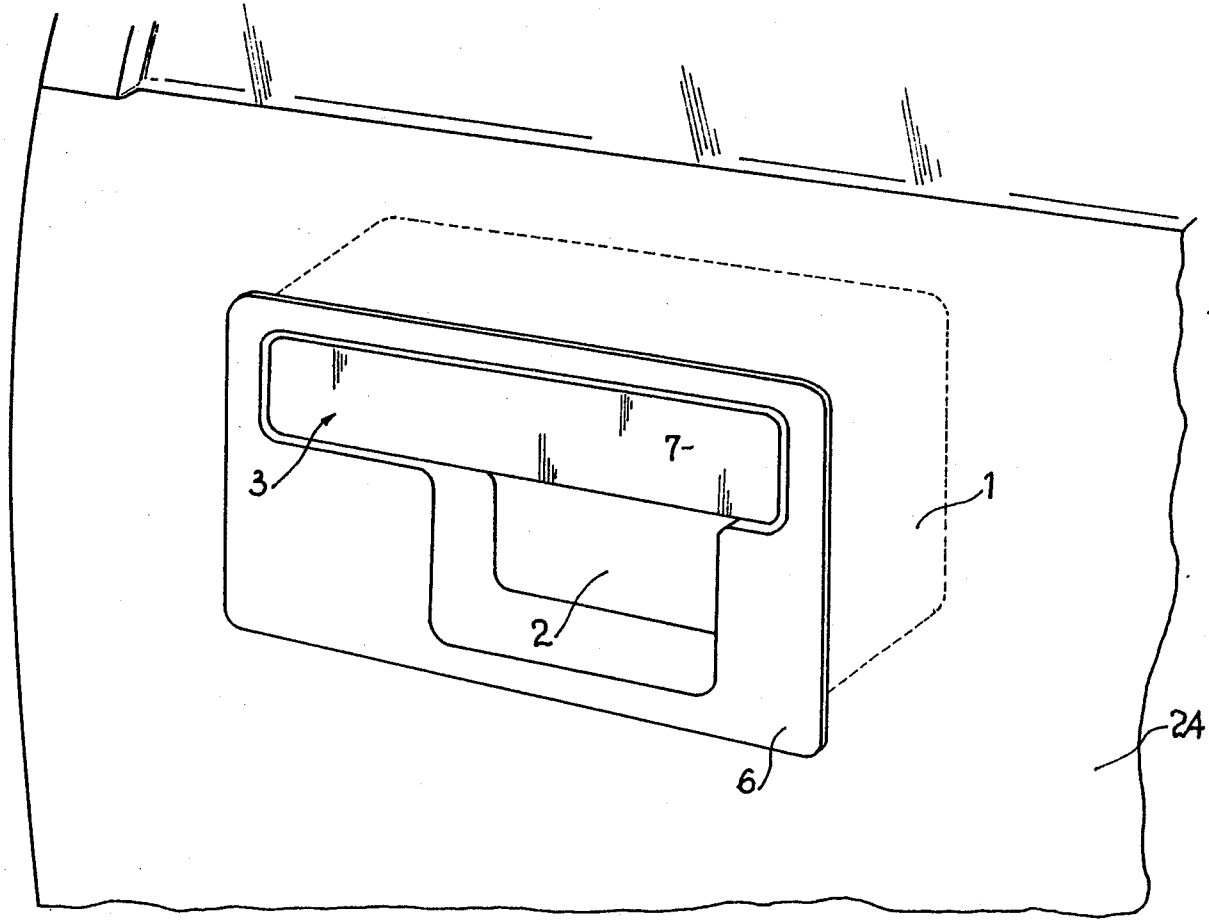
FIG. 1 is an outside perspective view of a unit comprising a knob and a case constituting a manual control device for a vehicle door according to the invention.

The manual control device for opening a vehicle door shown in FIG. 1 comprises a generally parallel-sided case 1 adapted to be disposed in a cut-away opening in the outer panel 24 of the door of the vehicle, in such manner that its outer surface 6 is flush with the surface of the outer panel of the door.

The case 1 is open on the exterior side and closed by an inner wall 2 on the interior side, and adapted to receive a knob 3 which is capable of pivoting a lever 4 (FIGS. 2 to 6) actuating an associated latch through a linkage known per se (not shown). The lever 4 is in major part located outside the inner wall 2 to which it is articulated by a pin 5. The front side of the case 1 is formed by an apertured plate 6 which permits the passage of the knob 3 and the fingers of a user for shifting this knob.

The knob 3 comprises a plate or pallet 7 provided with two side walls 8 extending in a direction perpendicular to the ends of the pallet 7 into the case 1. Each side wall 8 is articulated to two links 9, 11 and 12, 13 to pivot about respective movable pins 14 and 15. Furthermore, each pair of links 9, 11 and 12, 13 is also articulated at the ends thereof opposed to the movable pins 14, 15, to pivot about pins 16, 17 fixed to the case 1. The two links 9, 12 contiguous with the pallet 7 are integral with a connecting member 18 which is extended at one of its ends by a projecting tab 19 adapted to cooperate with a corresponding end tab 21 of the lever 4.

Preferably, the links 9, 11, the connecting member 18 and the tab 19 constitute a member in one piece.

The knob 3 is therefore laterally articulated by each of its side walls 8 to pivot about two pins 16, 17 fixed to the case 1 and, on the other hand, to pivot about two movable pins 14, 15 integral with said knob 3, all these pins 14 to 17 being within the case 1. Each fixed pin 16, 17 is connected to a movable pin 14, 15 by a respective link 9,11,12,13.

Note that the links 11 and 13 each have a lower end portion 11*a*, 13*a* which is cranked substantially at a right angle relative to the link proper and carries the movable articulation pin 15. These cranked end portions 11*a*, 13*a* extend into corresponding openings 10 provided in the inner wall 2 of the case 1.

Figure 4:
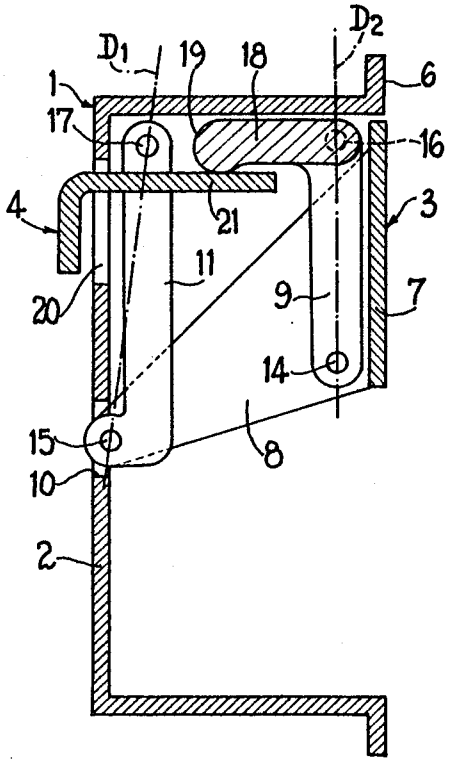
FIG. 4 is a semi-sectional and a transverse semi-elevational view in the direction of arrow 4 of FIG. 2, the manual knob being in an inoperative position within the case.

With this arrangement, the pins 14 to 17 are positioned in the case 1 in such manner that straight lines Dl, D2 (FIG. 4) each passing through a fixed pin 16, 17 and through a movable pin 14, 15 interconnected by the same link 9, 11 or 12, 13, intersect outside the case on a theoretical articulation axis of the knob 3 (not shown, FIG. 4).

Figure 2:
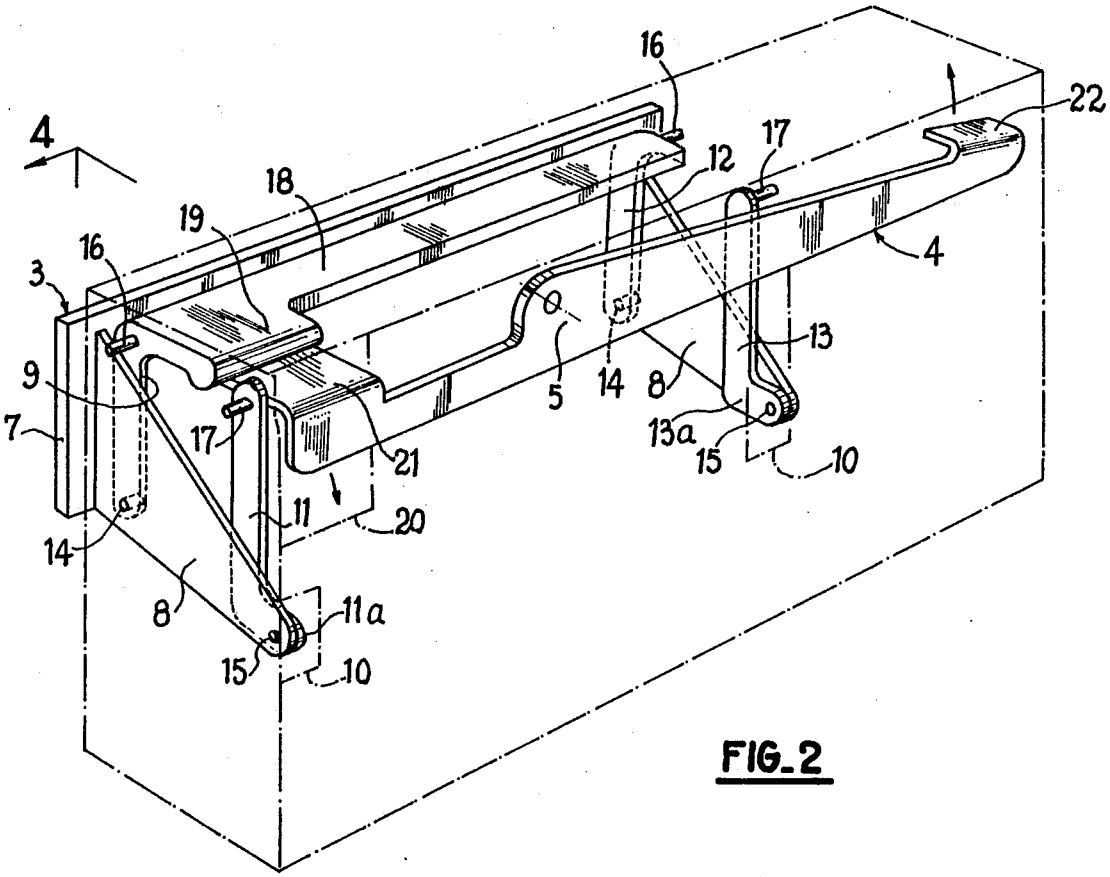
FIG. 2 is a perspective view of an embodiment of the articulated mechanism of the pivotable knob of the device shown in FIG. 1.
Figure 6:
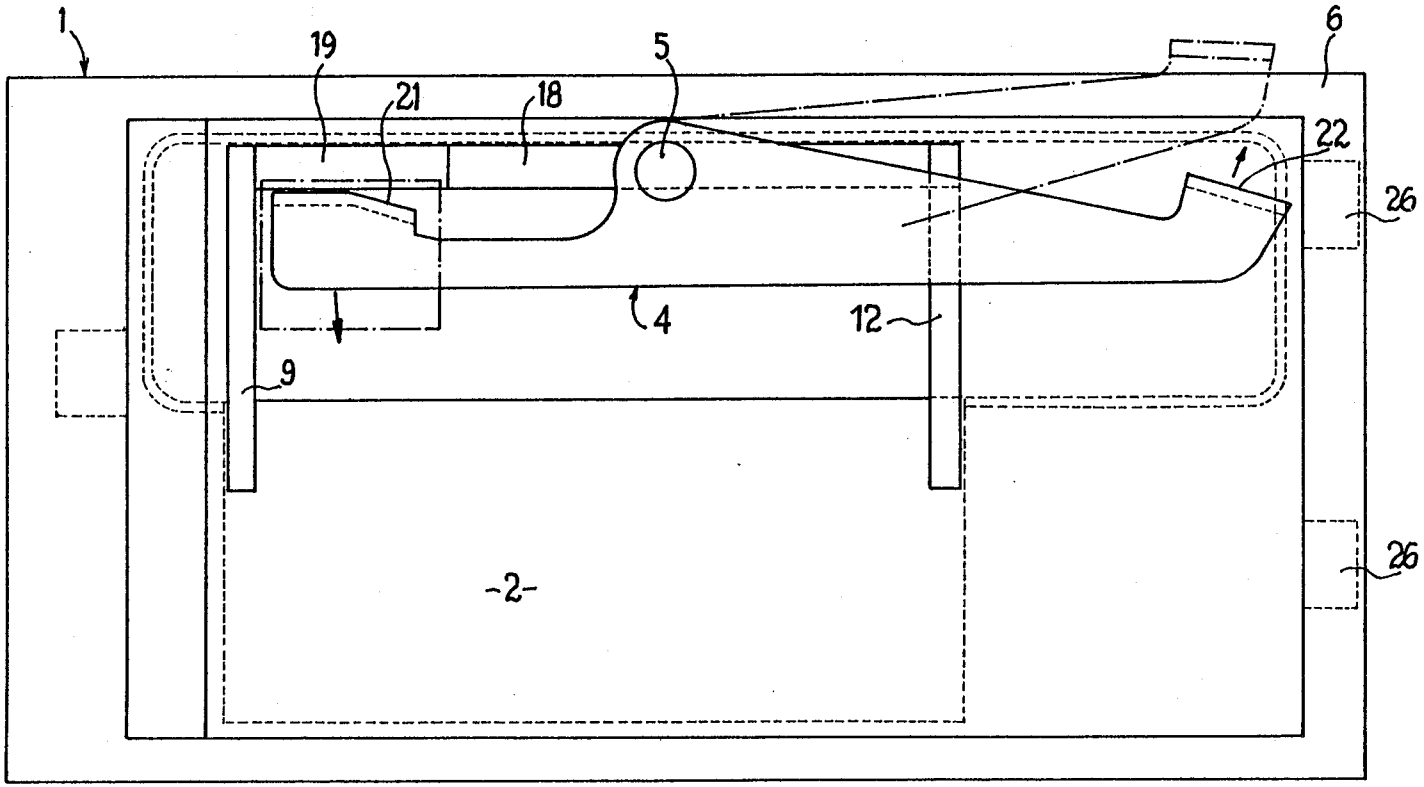
FIG. 6 is a rear elevational view of the mechanism shown in FIG. 2.

The operation of the device just described is as follows:

At rest, the device is in the position illustrated in FIGS. 2, 4 and 6. The knob 3 is completely withdrawn into the case 1 and its pallet 7 is located substantially in the plane of the outer surface 6 of the case 1. The lever 4 is substantially horizontal, its tab 21 which extends through an opening 20 in the inner wall 2, being in contact with the tab 19 and the two pins 15 being located in the openings 10.

In order to pivot the knob 3, the user introduces his fingers into the opening of the front plate 6, then behind the pallet 7 which is pulled outwardly. The knob 3 therefore drives the links 9, 11 and 12, 13 through the movable pins 14, 15 which accompany the movement of the knob 3, while the links 9, 11 pivot about the fixed pins 16, 17. At the same time, the projecting tab 19 lowers the tab 21 of the lever 4 which rotates about its pin 5 and whose end 22 opposed to the tab 21 actuates the latch opening linkage.

After releasing the knob 3, the latter and the links 9 to 13 return to their initial position by effecting movements which are the opposite of the preceding movements, as does the lever 4, under the action of a spring (not shown) associated with the lever 4 in the known manner.

On one of the vertical sides, the front plate 6 of the case 1 has recesses 26 (FIGS. 3 and 6) in which are capable of being introduced projecting maintaining lugs 25 of the outer panel 24.

The preassembled unit constituted by the case 1, the knob 3 and its mechanism for articulating it to the case, may be very simply placed in position by a suitably programmed robot. Indeed, it is sufficient that the latter introduce the unit in the cut-away opening of the door by a first horizontal movement of translation perpendicular to the general plane of the door, then effect a second horizontal movement of translation perpendicular to the first-mentioned movement to cause the lugs 25 to enter the recesses 26.

Figure 3:
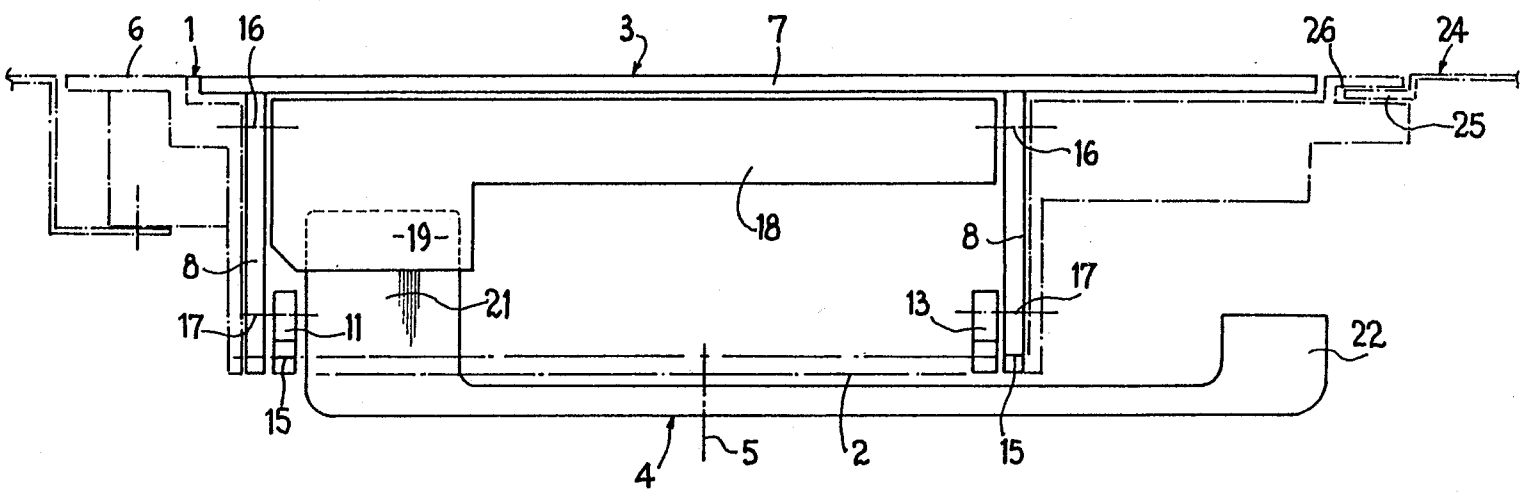
FIG. 3 is a plan view of the device shown in FIG. 2.
Figure 5:
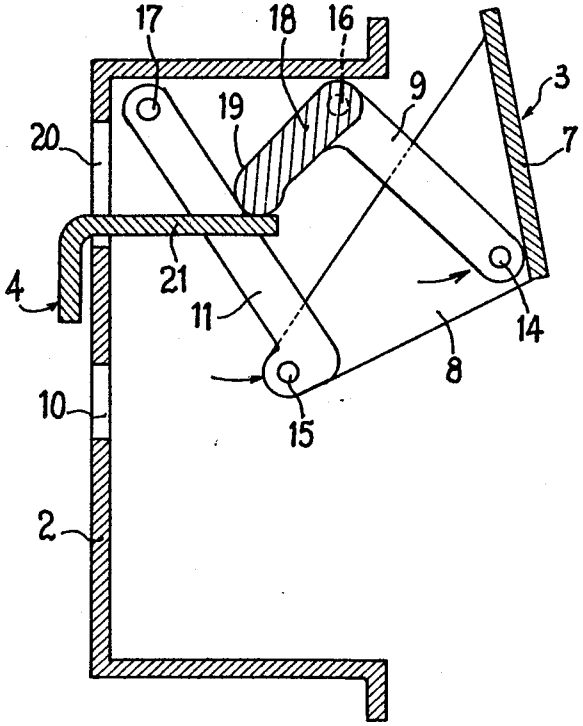
FIG. 5 is a view similar to FIG. 4 of the knob in an operative position for opening the latch after having pivoted toward the of the case.

The final position of the unit may be ensured by a clipping together or a screwing of the case 1 onto the panel 24 from the inside of the door (FIG. 3).

The described articulation mechanism may be modified without departing from the scope of the invention, so long as the effective articulation pins of the knob 3 remain circumscribed within the volume defined by the case 1.

I claim:

1. A manual control device for opening a vehicle door, comprising a case, a pivotable actuating lever of an associated latch, a knob capable of pivoting the actuating lever, the case being open toward the exterior and receiving the knob, two fixed pins fixed to the case and two movable pins integral with the knob associated with opposite sides of the knob, the knob being articulated on said opposite sides thereof to pivot about said two fixed pins and about said two movable pins, all of said pins being within the case, links respectively connecting, each fixed pin to a movable pin and all of said pins being so positioned that straight lines each passing through a fixed pin and a movable pin interconnected by the same link intersect outside the case.

2. A device according to claim 1, wherein the knob comprises a pallet having two lateral side walls extending inside the case, each lateral wall being articulated to two of said links, of which the articulations to the side walls constitute said movable pins and the articulations to the case constitute said fixed pins, and two links each cooperative with a respective side wall being integral with a connecting member adapted in such manner that the pivoting thereof about the two associated fixed pins drivingly engages the actuating lever of the latch.

3. A device according to claim 2, wherein the connecting member interconnects those of said links which are contiguous with the pallet, a tab provided on the connecting member projecting into the case and cooperative with a corresponding end of the actuating lever inside the case, the remainder of the actuating lever extending outside an inner wall of the case.

* * * * *